US007413503B2

(12) United States Patent
Tabata et al.

(10) Patent No.: US 7,413,503 B2
(45) Date of Patent: Aug. 19, 2008

(54) ELASTIC POLISHING TOOL AND LENS POLISHING METHOD

(75) Inventors: Yoshinori Tabata, Ina (JP); Keiko Kitamura, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/269,635

(22) Filed: Nov. 9, 2005

(65) Prior Publication Data

US 2006/0099889 A1 May 11, 2006

(30) Foreign Application Priority Data

| | | |
|---|---|---|
| Nov. 9, 2004 | (JP) | 2004-324758 |
| Feb. 9, 2005 | (JP) | 2005-032769 |
| May 26, 2005 | (JP) | 2005-153551 |
| Jun. 13, 2005 | (JP) | 2005-171947 |

(51) Int. Cl.
*B24B 1/00* (2006.01)

(52) U.S. Cl. ..... 451/42; 451/158; 451/138; 451/274

(58) Field of Classification Search ..... 451/42, 451/158, 277, 287, 290, 274, 390, 921, 138
See application file for complete search history.

(56) References Cited

U.S. PATENT DOCUMENTS

| | | | | |
|---|---|---|---|---|
| 3,583,111 | A * | 6/1971 | Volk | 451/490 |
| 4,019,289 | A * | 4/1977 | Korver | 451/527 |
| 4,458,454 | A * | 7/1984 | Barnett | 451/42 |
| 4,979,337 | A * | 12/1990 | Duppstadt | 451/550 |
| 5,095,660 | A * | 3/1992 | Dillon | 451/163 |
| 5,695,393 | A * | 12/1997 | Granziera | 451/390 |
| 6,942,554 | B1 * | 9/2005 | Mandina | 451/165 |
| 7,066,794 | B2 * | 6/2006 | Granziera et al. | 451/158 |
| 2002/0061717 | A1 * | 5/2002 | Goulet et al. | 451/42 |
| 2004/0224619 | A1 * | 11/2004 | Granziera et al. | 451/277 |
| 2005/0107008 | A1 * | 5/2005 | Miyazawa | 451/41 |
| 2006/0009126 | A1 * | 1/2006 | Kuebler et al. | 451/5 |
| 2006/0148391 | A1 * | 7/2006 | Ono et al. | 451/526 |

FOREIGN PATENT DOCUMENTS

| | | |
|---|---|---|
| JP | 52-080597 | 7/1997 |
| JP | 2000-317797 A | 11/2000 |
| JP | 2001-54862 A | 2/2001 |
| JP | 2000317797 A | 3/2001 |
| JP | 2002-172550 | 6/2002 |
| JP | 2002-263998 | 9/2002 |
| JP | 2002-283204 | 10/2002 |
| JP | 2003-165045 A | 6/2003 |
| JP | 2003-275949 A | 9/2003 |

* cited by examiner

*Primary Examiner*—Eileen P. Morgan
(74) *Attorney, Agent, or Firm*—Sughrue Mion, PLLC

(57) ABSTRACT

An elastic polishing tool that comes into contact with a surface to be polished of a lens and rotates to polish the surface, includes: an elastic polishing body which has a cylindrical shape and whose shape can be changed according to the surface to be polished; and a polishing pad that is adhered to one surface of the elastic polishing body opposite to the surface to be polished of the lens, wherein the polishing pad has a diameter larger than the length of an arc of the elastic polishing body in a cross section including a rotation axis of the elastic polishing tool.

8 Claims, 6 Drawing Sheets

ELASTIC POLISHING TOOL AND LENS POLISHING METHOD

BACKGROUND

1. Technical Field

The present invention relates to a polishing tool and a polishing method suitable for polishing an optical surface of an optical element, such as a lens, and more particularly, to an elastic polishing tool and a polishing method suitable for polishing an aspherical surface.

2. Related Art

In the related art, a concave optical surface of a spectacle lens, such as a spherical surface, a rotation-symmetry aspherical surface, a toric surface, or a progressive surface, is formed by cutting. Then, the formed optical surface is mirror-polished. A rub polishing method using a rigid polishing plate is generally used to mirror-polish a simple curved surface, such as a spherical surface or a toric surface. Since the mirror polishing method using the polishing plate transfers the surface shape of the polishing plate onto a surface to be polished, it is necessary to prepare polishing plates equal to the number of surface shapes corresponding to lens prescriptions. There are several thousands of types of polishing plates.

Further, it is difficult to polish a free curved surface, such as a progressive surface having a complicated shape, using the rigid polishing plate. Therefore, an elastic polishing tool is generally used to polish the free curved surface.

A polishing method using a balloon-type polishing tool is disclosed in JP-A-2003-275949 as the polishing method using the elastic polishing tool. In this polishing method, pressure air is pumped into the balloon-type polishing tool to inflate it, and the pressure of air is adjusted to change the curvature of the polishing tool according to the shape of a curved surface to be polished, thereby performing polishing. Therefore, it is possible to cope with a plurality of polishing surfaces having different curved surface shapes, which makes it possible to polish a plurality of surfaces having different shapes by using only one balloon-type polishing tool.

Further, there is a partial polishing method using a dome-shaped elastic polishing tool which comes into contact with a portion of a surface to be polished (for example, see JP-A-2000-317797). The polishing method is the method of polishing the entire surface to be polished by connecting local polished areas polished by a small elastic polishing tool.

In the related art, a polished spectacle lens to be fitted to a spectacle frame generally has a circular shape. However, in recent years, with a reduction in the thickness of a spectacle lens, a polishing process has been performed to obtain the smallest thickness at the center of the lens on the basis of spectacle frame data and a lens prescription. Therefore, the production of a spectacle lens having a substantially elliptical (aspherical) outward shape and a sharp edge tends to increase.

However, in the polishing method using the balloon-type elastic polishing tool disclosed in JP-A-2003-275949, since the balloon-type elastic polishing tool comes into contact with the entire surface of a polishing target to polish it, it is possible to polish the polishing target in a short time. However, when a lens having a substantially elliptical outward shape and a sharp edge is polished, the edge of the lens is dug into a polishing pad adhered to a balloon polishing portion, which causes the polishing pad to be peeled off or the polished lens and the polishing tool to be damaged. When the internal pressure of the balloon polishing portion is raised in order to solve this problem, flexibility is deteriorated, and shape trackability is degraded. As a result, an unpolished region or polishing irregularity may occur.

Meanwhile, in the partial polishing method using the elastic polishing tool disclosed in JP-A-2000-317797, polishing is performed while moving the elastic polishing tool on the entire surface a material to be polished. Therefore, since an elastic body coming into contact with a surface to be polished can change the shape thereof according to the shape of the surface to be polished, polishing irregularity hardly occurs in a polished surface of a lens having a circular outward shape. However, when a lens having a substantially elliptical outward shape and a sharp edge is polished, the elastic polishing tool intermittently comes into contact with the lens. Therefore, the edge of the lens is dug into the polishing pad, which causes the polishing pad to be peeled off, or causes the polished lens and the polishing tool to be damaged.

SUMMARY

An advantage of some aspects of the invention is that it provides an elastic polishing tool and a lens polishing method capable of, when an optical surface of an optical element, such as a lens, is polished, preventing a polishing pad from being peeled off and of performing polishing without unnecessary scratches on a surface to be polished.

According to an aspect of the invention, there is provided an elastic polishing tool that comes into contact with a surface to be polished of a lens and rotates to polish the surface. The elastic polishing tool includes an elastic polishing body which has a cylindrical shape and whose shape can be changed according to the surface to be polished; and a polishing pad that is adhered to one surface of the elastic polishing body opposite to the surface to be polished of the lens. The polishing pad has a diameter larger than the length of an arc of the elastic polishing body in a cross section including a rotation axis of the elastic polishing tool.

According to this structure, the polishing pad adhered to one surface of the elastic polishing body opposite to the surface to be polished of the lens has a diameter larger than the length of the arc of the elastic polishing body in the cross section including the rotation axis of the elastic polishing tool. Therefore, the polishing pad is adhered to the entire surface of the elastic polishing body including the edge thereof, and thus the elastic polishing body is not exposed. Thus, when the elastic polishing tool is rotated while coming into contact with the surface to be polished, thereby performing polishing, only the polishing pad contacts the surface to be polished of the lens. As a result, polishing can be performed without scratching the surface to be polished. In addition, since the surface area of the polishing pad is larger than that of the elastic polishing body, it is possible to improve polishing efficiency.

Further, in the above-mentioned structure, it is preferable that the diameter of the polishing pad be 1.01 to 1.60 times the length of the arc of the elastic polishing body.

According to this structure, since the diameter of the polishing pad is 1.01 to 1.60 times the length of the arc of the elastic polishing body, it is possible to optimize the size of the polishing pad. In the case in which the diameter of the polishing pad is smaller than 1.01 times the length of the arc of the elastic polishing body, when the elastic polishing tool scans the entire surface of the surface to be polished of the lens, the edge of the polishing pad comes into contact with the surface to be polished and thus polishing scratches occur. Thus, in this case, it is difficult to attain the above-mentioned advantage of the invention. On the other hand, when the diameter of the polishing pad is larger than 1.60 times the length of the arc of the elastic polishing body, the area of the polishing not to come into contact with the surface to be polished of the lens increases, and a portion of the polishing pad is not used for polishing, which results in a low degree of polishing efficiency.

Further, in the above-mentioned structure, it is preferable that the diameter of the polishing pad have a value obtained by the following expression: (the length of the arc of the elastic polishing body+the length of a cylindrical portion of the elastic polishing body×4.00)≧the diameter of the polishing pad≧(the length of the arc of the elastic polishing body+the length of the cylindrical portion of the elastic polishing body×0.05).

According to this structure, the diameter of the polishing pad has the value obtained by the following expression: (the length of the arc of the elastic polishing body+the length of a cylindrical portion of the elastic polishing body×4.00)≧the diameter of the polishing pad≧(the length of the arc of the elastic polishing body+the length of the cylindrical portion of the elastic polishing body×0.05). Therefore, even when an elastic polishing body having a cylindrical portion with a different length is used, it is possible to optimize the size of the polishing pad. In a case in which the diameter of the polishing pad is smaller the value obtained by the following expression: the length of the arc of the elastic polishing body+the length of the cylindrical portion of the elastic polishing body×0.05, when the elastic polishing tool scans the entire surface of the surface to be polished, the edge of the polishing pad comes into contact with the surface to be polished and thus polishing scratches occur. Thus, in this case, it is difficult to attain the above-mentioned advantage of the invention. On the other hand, when the diameter of the polishing pad is larger than the value obtained by the following expression: the length of the arc of the elastic polishing body+the length of a cylindrical portion of the elastic polishing body×4.00, the area of the polishing not to come into contact with the surface to be polished of the lens increases, and a portion of the polishing pad is not used for polishing, which results in a low degree of polishing efficiency.

Moreover, in the above-mentioned structure, it is preferable that the elastic polishing body be formed of a thermoplastic resin.

According to this structure, since the elastic polishing body is formed of a thermoplastic resin, it is possible to perform a polishing process according to surfaces of lenses having plural kinds of curved surface shapes and thus to easily form a predetermined optical surface.

Further, in the above-mentioned structure, it is preferable that the polishing pad be a non-woven fabric or a sheet formed of a porous material.

According to this structure, since the polishing pad is a non-woven fabric or a sheet formed of a porous material, it is possible to perform a polishing process according to a surface of a lens having a large amount of aspherical surface and thus to easily form a predetermined optical surface.

Furthermore, according to another aspect of the invention, a lens polishing method includes bringing an elastic polishing tool having an outer diameter smaller than an outmost diameter of a lens into contact with a surface to be polished of the lens; and rocking the elastic polishing tool and/or the lens while rotating the lens and the elastic polishing tool, thereby performing polishing. The elastic polishing tool includes an elastic polishing body which has a cylindrical shape and whose shape can be changed according to the surface to be polished; and a polishing pad that has a diameter which is 1.01 to 1.60 times the length of an arc of the elastic polishing body in the cross section including a rotation axis of the elastic polishing tool and that is adhered to one surface of the elastic polishing body opposite to the surface to be polished of the lens.

According to this aspect, the lens polishing method is performed by bringing, into contact with the surface to be polished of the lens, the elastic polishing tool including the elastic polishing body whose shape can be changed according to the shape of the surface to be polished and the polishing pad that has a diameter which is 1.01 to 1.60 times the length of the arc of the elastic polishing body and that is adhered to one surface of the elastic polishing body opposite to the surface to be polished of the lens; and by rocking the elastic polishing tool and/or the lens while rotating the lens and the elastic polishing tool. Therefore, it is possible to optimize the size of the polishing pad, and thus to prevent the polishing pad from being peeled off. In this way, it is possible to efficiently polish the entire surface of the surface to be polished, without damaging a polishing tool and a lens to be polished and scratching the polished surface. In addition, in the polishing method, polishing may be performed while supplying a polishing agent, if necessary.

Moreover, according to still another aspect of the invention, a lens polishing method includes bringing an elastic polishing tool having an outer diameter smaller than an outmost diameter of a lens into contact with a surface to be polished of the lens; and rocking the elastic polishing tool and/or the lens while rotating the lens and the elastic polishing tool, thereby performing polishing. The elastic polishing tool includes an elastic polishing body which has a cylindrical shape and whose shape can be changed according to the shape of the surface to be polished; and a polishing pad that is adhered to one surface of the elastic polishing body opposite to the surface to be polished of the lens and that has, as a diameter, a value obtained by the following expression: (the length of the arc of the elastic polishing body+the length of a cylindrical portion of the elastic polishing body×4.00)≧the diameter of the polishing pad≧(the length of the arc of the elastic polishing body+the length of the cylindrical portion of the elastic polishing body×0.05).

According to this aspect, the elastic polishing tool includes the elastic polishing body which has a cylindrical shape and whose shape can be changed according to the shape of the surface to be polished; and the polishing pad that is adhered to one surface of the elastic polishing body opposite to the surface to be polished of the lens and that has, as a diameter, the value obtained by the following expression: (the length of the arc of the elastic polishing body+the length of a cylindrical portion of the elastic polishing body×4.00)≧the diameter of the polishing pad≧(the length of the arc of the elastic polishing body+the length of the cylindrical portion of the elastic polishing body×0.05). The polishing method is performed by bringing the elastic polishing tool into contact with a surface to be polished of the lens and by rocking the elastic polishing tool and/or the lens while rotating the lens and the elastic polishing tool. Therefore, it is possible to optimize the size of the polishing pad, and thus to prevent the polishing pad from being peeled off. In this way, it is possible to efficiently polish the entire surface of the surface to be polished, without damaging a polishing tool and a lens to be polished and scratching the polished surface.

Further, according to yet another aspect of the invention, a lens polishing method includes bringing an elastic polishing tool having an outer diameter smaller than an outmost diameter of a lens whose outer circumferential portion has a substantially elliptical shape into contact with a surface to be polished of the lens; and rocking the elastic polishing tool and/or the lens while rotating the lens and the elastic polishing tool, thereby performing polishing. In this polishing method, a moving range of a rotation center of the elastic polishing tool which moves relative to the lens is within a moving range of a rotation center of the elastic polishing tool which moves relative to the lens is within a shortest diameter of the substantially elliptical shape.

According to this aspect, the lens polishing method is performed by bringing the elastic polishing tool having an outer diameter smaller than the outmost diameter of the lens whose outer circumferential portion has a substantially elliptical shape into contact with the surface to be polished of the lens, and by rocking the elastic polishing tool and/or the lens while rotating the lens and the elastic polishing tool. In this case, the moving range of a rotation center of the elastic polishing tool which moves relative to the lens is within the shortest diameter of the substantially elliptical shape. Therefore, even when the lens has a substantially elliptical shape and a sharp edge, the edge of the lens is not dug into the polishing pad adhered to the elastic polishing tool. In this way, the polishing pad is not peeled off, and thus mirror polishing can be performed on the entire surface of the surface to be polished of the lens without polishing chips and scratches. In addition, the substantially elliptical shape means an aspherical shape including at least an arc in the outline of the outer circumferential portion. For example, the substantially elliptical shape includes oval shapes such as an elliptical shape and an egg shape.

Furthermore, in the above-mentioned aspect, it is preferable that the diameter of the elastic polishing tool have a value obtained by the following expression: the outer diameter of the elastic polishing tool≧(the outmost diameter of the lens—the shortest diameter of the lens).

According to this structure, the diameter of the elastic polishing tool has the value obtained by the following expression: the outer diameter of the elastic polishing tool≧(the outmost diameter of the lens—the shortest diameter of the lens), and the moving range of the elastic polishing tool that moves relative to the lens is within the shortest diameter of the lens having the substantially elliptical shape. Therefore, even when the lens has a substantially elliptical shape and a sharp edge, the edge of the lens is not dug into the polishing pad adhered to the elastic polishing tool. In this way, the polishing pad is not peeled off, and thus mirror polishing can be performed on the entire surface of the surface to be polished of the lens without polishing chips and scratches.

In the above-mentioned aspect, it is preferable that the moving range of the rotation center of the elastic polishing tool with respect to the lens, that is, a circular region that is drawn when the rotation center of the elastic polishing tool moved relative to the lens comes into contact with the lens, be between the rotation center of the lens and a part of the outer circumferential portion closest to the rotation center of the lens.

According to this structure, the moving range of the rotation center of the elastic polishing tool with respect to the lens, that is, the circular region that is drawn when the rotation center of the elastic polishing tool moved relative to the lens comes into contact with the lens, is between the rotation center of the lens and a part of the outer circumferential portion closest to the rotation center of the lens. Therefore, the moving range of the elastic polishing tool is within the shortest diameter of the substantially elliptical shape. Thus, even when the lens has a substantially elliptical shape and a sharp edge, the edge of the lens is not dug into the polishing pad adhered to the elastic polishing tool. In this way, the polishing pad is not peeled off, and thus mirror polishing can be performed on the entire surface of the surface to be polished of the lens without polishing chips and scratches.

Moreover, in the above-mentioned aspect, it is preferable that the lens polishing method further include calculating a surface shape and an outward shape of the lens; shaping the surface to be polished, on the basis of the calculated surface shape and outward shape; and polishing the shaped surface.

According to this polishing method, the surface shape and the outward shape of the lens are calculated, and the surface to be polished is shaped on the basis of the calculated surface shape and outward shape. Then, the shaped surface is polished. Therefore, a ruffling phenomenon, such as burr, does not occur in the circumferential edge of the lens. In addition, even when the shaped lens has a substantially elliptical shape and a sharp edge, the edge of the lens is not dug into the polishing pad adhered to the elastic polishing tool. In this way, the polishing pad is not peeled off, and thus mirror polishing can be performed on the entire surface of the surface to be polished of the lens without polishing chips and scratches.

When the burr occurs after shaping the lens, it is preferable to perform a chamfering process. Therefore, in the above-mentioned aspect, preferably, a thinnest part of the outer circumferential portion has a thickness which is larger than zero and is smaller than 2 mm after the surface to be polished is shaped.

According to this structure, when the thinnest part of the outer circumferential portion has a thickness of zero (0) after the surface to be polished is shaped, the burr occurs in the circumferential edge of the lens. Therefore, in order to prevent the occurrence of the burr, it is effective to set the thickness of the thinnest part of the outer circumferential portion after the surface to be polished is shaped to be larger than zero. On the other hand, when the thinnest part of the outer circumferential portion has a thickness larger than 2 mm after the surface to be polished is shaped, the lens is formed to be smaller than an inner frame shape (the lens insertion shape into the spectacle frame) in size. It is effective that the thinnest part of the outer circumferential portion after the surface to be polished is shaped has a thickness smaller than 2 mm.

Further, the thinnest part of the outer circumferential portion after the surface to be polished is shaped has a thickness which is larger than zero and is smaller than 2 mm. Therefore, when a surface treatment, such as an anti-scratch treatment, is performed on the polished surface, it is possible to prevent a processing agent from being collected in depressions due to, for example, the burr of the outer circumferential edge of the lens. In addition, it is possible to prevent the edge of the lens from being dug into the elastic polishing tool due to the burr of the outer circumferential portion when the surface of the lens is polished.

BRIEF DESCRIPTION OF THE DRAWINGS

The invention will be described with reference to the accompanying drawings, wherein like numbers reference like elements.

FIG. 4A is a top view illustrating a state in which an outmost diameter portion of a polishing target is polished; and FIG. 4B is a top view illustrating a state in which the polishing target is rotated from the position shown in FIG. 4A by 90°.

DESCRIPTION OF EXEMPLARY EMBODIMENTS

An elastic polishing tool and a polishing method according to the invention can be applied to an optical lens, and more particularly, to a spectacle lens.

In the spectacle lens, a semifinished lens having an optical characteristic on only one surface thereof is formed by a hardening reaction, using a glass lens having an optical characteristic on the inside of a convex surface or a concave surface thereof. Then, a cutting process or a grinding process is performed on the other surface of the semifinished lens not having the optical characteristic (in general, the concave surface), and a polishing process is further performed thereon, so that the other surface has a predetermined optical characteristic.

Since the semifinished lens should be processed into a desired lens by, for example, polishing, the semifinished lens is formed with a large width. In addition, the semifinished lens is generally formed in a circular shape in appearance. Alternatively, for example, a cutting process may be performed thereon such that the thinnest central thickness is obtained, and thus the lens may have a substantially elliptical shape in appearance. The substantially elliptical lens has a sharp edge. In this case, the smaller the length of the short side of the substantially elliptical shape is, the more sharp the edge thereof becomes. In addition, in general, the semifinished lens has an outer diameter (the outmost diameter) of about 40 to 80 mm.

Further, the lens to which a cutting process has bee performed is polished to have a predetermined optical characteristic, and a surface treatment is performed on the lens to prevent the damage of the surface thereof. Then, for example, a lens process is performed thereon to rub the edge of the lens according to the inner circumferential shape of a spectacle frame. The processed lens is fitted to the spectacle frame, thereby completing a spectacle.

Hereinafter, an embodiment of the invention will be described with reference to the accompanying drawings.

In this embodiment, a plastic spectacle lens to be polished (hereinafter, referred to as a spectacle lens) is described as an example.

First, an elastic polishing tool 1 will be described with reference to FIGS. 1 and 2.

Figure 1A:
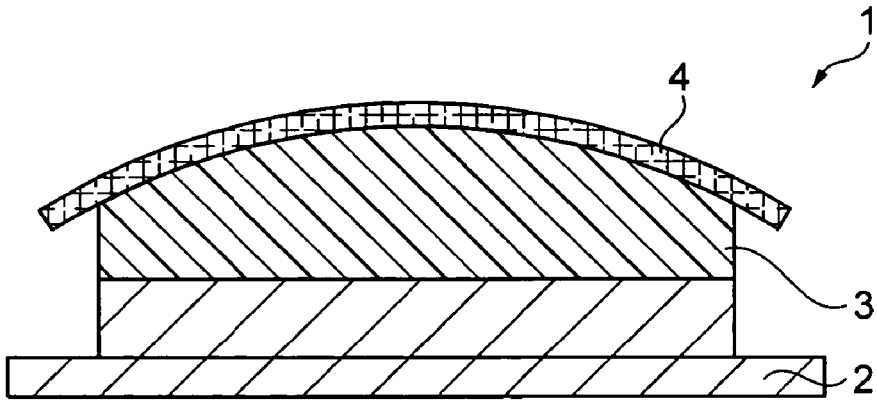
FIG. 1A is a cross-sectional view of an elastic polishing tool according to the invention.
Figure 1B:
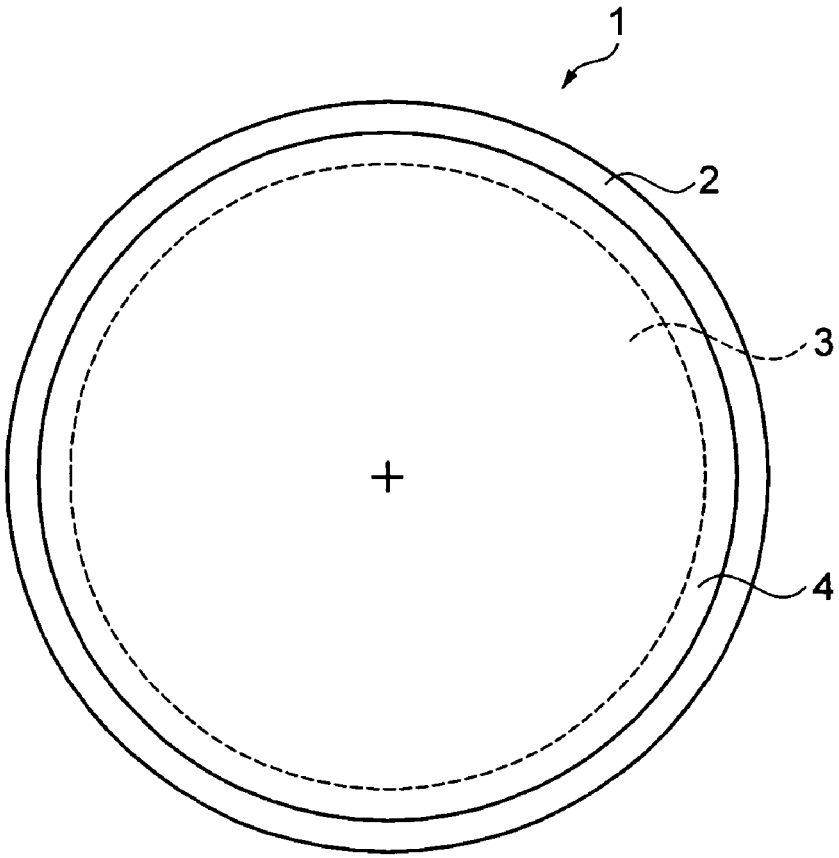
FIG. 1B is a top view of the elastic polishing tool according to the invention.
Figure 2:
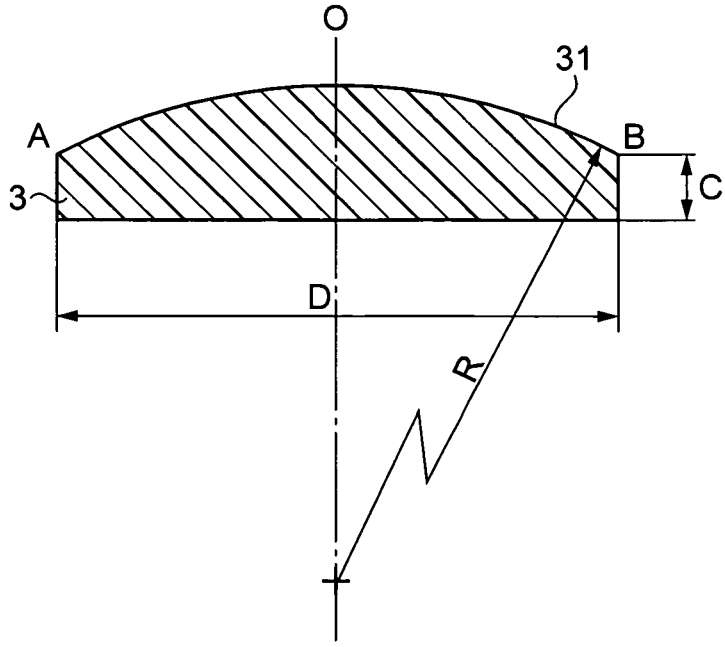
FIG. 2 is a schematic cross-sectional view of the elastic polishing tool.

FIG. 1A is a cross-sectional view of the elastic polishing tool according to the invention. FIG. 1B is a top view of the elastic polishing tool according to the invention. FIG. 2 is a cross-sectional view schematically illustrating the elastic polishing tool according to the invention.

The elastic polishing tool 1 includes a polishing body base 2, an elastic polishing body 3, and a polishing pad 4. In the elastic polishing tool 1, the elastic polishing body 3 is mounted on the polishing body base 2, and the polishing pad 4 is mounted on the elastic polishing body 3. The elastic polishing tool 1 is fitted to a polishing shaft of a polishing machine, and rotates to polish a spectacle lens 5 into an aspherical shape (a surface 5*a* to be polished, see FIG. 3). In order to perform a polishing process while maintaining the aspherical shape of the spectacle lens 5, the outer diameter of the elastic polishing tool 1 is set to be smaller than the outmost diameter of the spectacle lens 5. Further, in this embodiment, the outer diameter of the elastic polishing tool 1 indicates the diameter of the elastic polishing body 3.

The polishing body base 2 is made of a relatively hard material, such as a metallic material or a hard plastic resin, and is formed in a cylindrical shape with a flange at one end thereof. The polishing body base 2 is fitted to the polishing shaft of the polishing machine (not shown) with the central axis of the cylindrical portion positioned at the center, and the elastic polishing body 3 is mounted on the other surface (the upper surface) of the cylindrical polishing body base 2.

The elastic polishing body 3 is formed of an elastic material, such as silicon, whose shape can be changed according to a surface 5*a* to be polished of the spectacle lens 5. The elastic polishing body 3 is formed in a cylindrical shape, and a dome-shaped curved surface 31 having a predetermined curvature radius R whose surface shape is similar to that of the surface 5*a* to be polished of the spectacle lens 5 is formed on one surface of the cylindrical portion. In addition, the other surface of the cylindrical elastic polishing body 3 is attached to the upper surface of the polishing body base 2 by, for example, an adhesive, with the central axis thereof substantially coinciding with the central axis of the polishing body base 2. In order to easily perform the attachment, it is preferable that a diameter D of the elastic polishing body 3 be set to be equal to the diameter of the cylindrical polishing body base 2.

A length (height) C of the elastic polishing body 3 is set to a predetermined value, considering, for example, the size of the spectacle lens 5 to be polished, the shape of the curved surface thereof, and a material forming the elastic polishing body 3. In addition, when polishing pressure is applied to the elastic polishing tool 1 to polish a material (the spectacle lens 5), preferably, the length of the elastic polishing tool 1 is set such that the polishing body base 2 does not come into contact with the spectacle lens 5 when the elastic polishing body 3 is pressed down by pressure.

In general, since the spectacle lens 5 has a largest diameter of about 80 mm, a diameter D of the elastic polishing body 3 is set in a range of 20 to 60 mm. When the diameter D is smaller than 20 mm, in order to reduce the contact area between the elastic polishing tool 1 and the surface 5*a* to be polished of the spectacle lens 5, the time (polishing time) required for scanning the entire surface 5*a* to be polished (see FIG. 3) is lengthened. Meanwhile, when the diameter D is larger than 60 mm, it is difficult to perform polishing while maintaining the aspherical shape of the surface 5*a* to be polished.

The elastic polishing body 3 can be formed of, for example, a rubber material, such as silicon rubber, natural rubber, nitrile rubber, chloroprene rubber, styrene-butadiene rubber (SBR), acrylonitrile-butadiene rubber (NBR), or fluoric rubber, a thermoplastic resin, such as polyethylene or nylon, or styrene-based or urethane-based thermoplastic resin elastomer.

Plural types of elastic polishing bodies 3 having curved surfaces 31 with different curvatures are prepared. When the inner surface (concave surface) of the spectacle lens 5 is polished, for example, the elastic polishing body 3 having a curvature radius R of 35 to 600 mm is prepared. When the curvature radius R is in the range of 35 to 200 mm, five to ten types of elastic polishing bodies having curvature radius intervals of 5 to 50 mm, preferably, 10 to 30 mm are prepared. When the curvature radius R is in the range of 200 to 600 mm, several types of elastic polishing bodies having curvature radius intervals of 100 to 200 mm are prepared. In this way, it is possible to cope with the curved surface of the concave surface (the surface 5*a* to be polished) of the spectacle lens 5 on the basis of almost all lens prescriptions. In addition, when the outer surface (the convex surface) of the spectacle lens is polished, it is possible to use the elastic polishing body 3 having a flat surface opposite to the surface to be polished (the convex surface).

The polishing pad 4 is composed of a non-woven fabric sheet having a circular shape. The polishing pad 4 is attached to a surface 31 of the elastic polishing body 3 opposite to the surface 5*a* by, for example, a double-sided adhesive tape, with the center of the circular sheet positioned substantially at the central axis of the surface 31.

The diameter of the polishing pad 4 is set to 1.01 to 1.60 times the length of an arc AB of the elastic polishing body 3 shown in the cross section including a central axis O of the cylindrical elastic polishing body 3.

Further, the diameter of the polishing pad 4 is set to a value obtained by the following expression: '(the length of the arc AB of the elastic polishing body 3+the length C of the cylindrical portion of the elastic polishing body 3×4.00)≧the diameter D of the polishing pad 4≧(the length of the arc AB of the elastic polishing body 3+the length C of the cylindrical portion of the elastic polishing body 3×0.05)'.

Furthermore, the length of the arc AB of the elastic polishing body 3 is the length of an arc of the elastic polishing body shown in the cross section including a rotation axis of the elastic polishing tool, that is, the length of an arc shown in the cross section including the central axis O of the cylindrical portion of the elastic polishing body 3. In addition, in this embodiment, the diameter of the polishing pad 4 indicates the length of the polishing pad 4 on the adhesive surface adhered to the curved surface 31 of the elastic polishing body 3.

In a case in which the diameter of the polishing pad 4 is smaller than 1.01 times the length of the arc AB of the elastic polishing body 3, when the elastic polishing tool 1 scans the entire surface of the surface 5*a* to be polished of the spectacle lens 5, the edge of the polishing pad 4 comes into contact with the surface 5*a* to be polished, which causes a polishing scratch to occur in the surface 5*a* to be polished. In addition, the ratio of the diameter of the polishing pad 4 to the length of the arc AB of the elastic polishing body 3 is changed by the length C of the cylindrical portion of the elastic polishing body 3 used. However, in this case, it does not matter what ratio value is used.

Further, the polishing pad 4 can be composed of a sheet formed of a porous material, such as felt or polyurethane, or a sheet having monofilaments plated therein, made of, for example, synthetic resin.

Next, a polishing method of polishing the inner surface (the surface 5*a* to be polished) of the spectacle lens 5 using the elastic polishing tool 1 will be described below.

Figure 3:
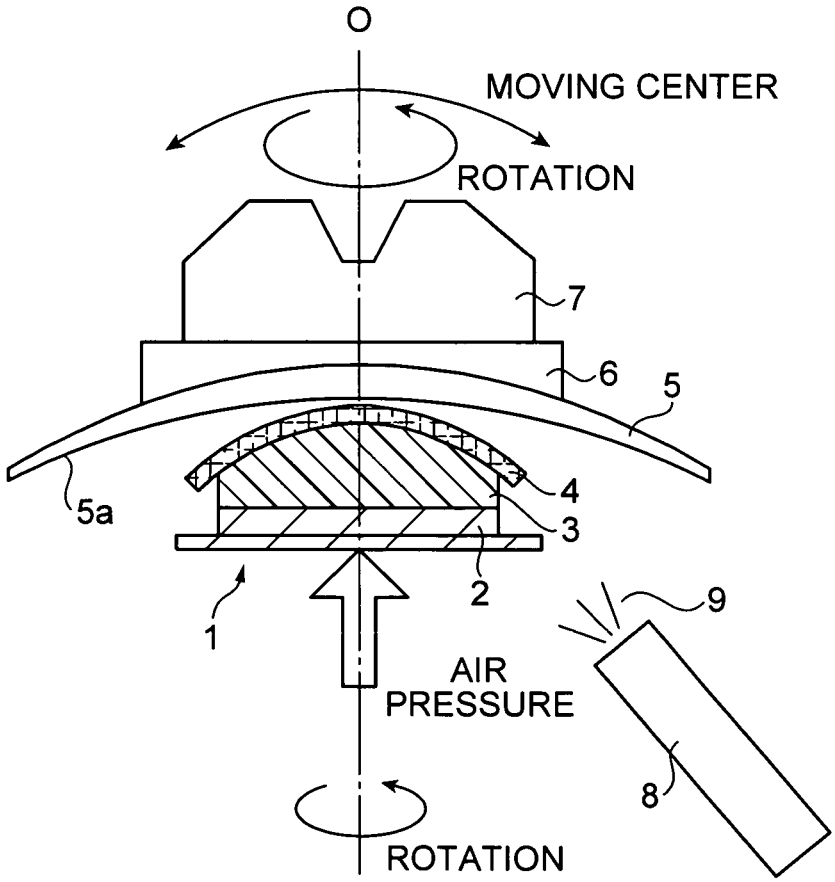
FIG. 3 is a side view schematically illustrating a process of polishing a spectacle lens using the elastic polishing tool according to the invention.

FIG. 3 is a side view schematically illustrating a process of polishing the spectacle lens using the elastic polishing tool. FIG. 4 is a top view schematically illustrating the relationship of the polishing position between the elastic polishing tool and the spectacle lens.

In FIG. 3, the elastic polishing tool 1 (the flange portion of the polishing body base 2) is fitted to a polishing shaft of a polishing machine (not shown). In the elastic polishing tool 1 fitted to the polishing shift of the polishing machine, the curved surface 31 of any one of plural types of elastic polishing bodies 3 has a curvature radius smaller than the average curvature radius of the surface 5*a* to be polished of the spectacle lens 5, and one of the plural types of elastic polishing bodies having a curvature radius closest to the curvature radius of the surface 5*a* to be polished is selected.

Further, the polishing shaft of the polishing machine has a function of bringing the elastic polishing tool 1 into pressure contact with the surface 5*a* to be polished of the spectacle lens 5 at predetermined pressure by applying, for example, air pressure. In addition, the polishing machine has a discharging nozzle 8 for supplying slurry 9 containing a polishing agent between the elastic polishing tool 1 and the surface 5*a* to be polished of the spectacle lens 5.

Meanwhile, the surface (the convex surface) of the spectacle lens 5, which is a polishing target, opposite to the surface 5*a* is mounted and fixed to a mounting jig through a bonding material 6 formed of, for example, metal having a low melting point or wax which is bonded to the mounting jig 7. In addition, the mounting jig 7 is mounted and fixed to a chuck (not shown) of the polishing machine having a rocking mechanism and a rotation mechanism operated by, for example, numerical control.

In the polishing method of the spectacle lens 5, first, the polishing shaft of the polishing machine is driven to rotate the elastic polishing tool 1 fitted to the polishing shaft. Then, air pressure is applied to a mechanism for bringing the polishing shaft into pressure contact with the surface 5*a* to be polished so as to bring the elastic polishing tool 1 into pressure contact with the surface 5*a* to be polished of the spectacle lens 5 at predetermined pressure. At the same time, the spectacle lens 5 is rotated at a predetermined number of rotations by the rotation mechanism of the chuck, and the rocking mechanism is operated to rock on the elastic polishing tool 1 (the surface of the polishing pad 4 attached to the curved surface 31 of the elastic polishing body 3).

With the rotation of the chuck and the polishing shaft, the slurry 9 containing a polishing agent is discharged from the discharging nozzle 8 between the elastic polishing tool 1 and the surface 5*a* to be polished, thereby performing polishing on the surface 5*a* to be polished of the spectacle lens 5.

Further, the rotation direction of the polishing shaft (the elastic polishing tool 1) of the polishing machine may be the same as or opposite to that of the chuck (the spectacle lens 5). However, it is preferable that the rotations directions thereof be opposite to each other from the viewpoint of the efficiency of polishing.

The pressing mechanism applies an air pressure of about 0.01 to 1.00 MPa to bring the elastic polishing tool 1 into pressure contact with the surface 5*a* to be polished of the spectacle lens 5. The number of rotations of the elastic polishing tool 1 (polishing shaft) is set in a range of about 100 to 1500 rpm. In addition, the number of rotations of the spectacle lens 5 (chuck) is set in a range of about 100 to 1500 rpm. The polishing process is executed while performing the rocking operation of the surface 5*a* to be polished of the spectacle lens 5 (chuck) at 1 to 20 reciprocations every minute.

Next, the polishing method of the spectacle lens 5 will be described with reference to the schematic top view of FIG. 4 illustrating the relationship of the polishing position between the elastic polishing tool and the spectacle lens.

The polishing method of the spectacle lens 5 in which the outline of an outer circumferential portion (outward shape) is a substantially elliptical shape and the edge thereof is sharp will be described. The substantially elliptical shape means an aspherical shape including at least an arc in the outline of the outer circumferential portion. In addition, the outline of the circumferential portion may have an oval shape in addition to the elliptical shape. In this embodiment, the substantially elliptical shape includes these shapes.

Figure 4A:
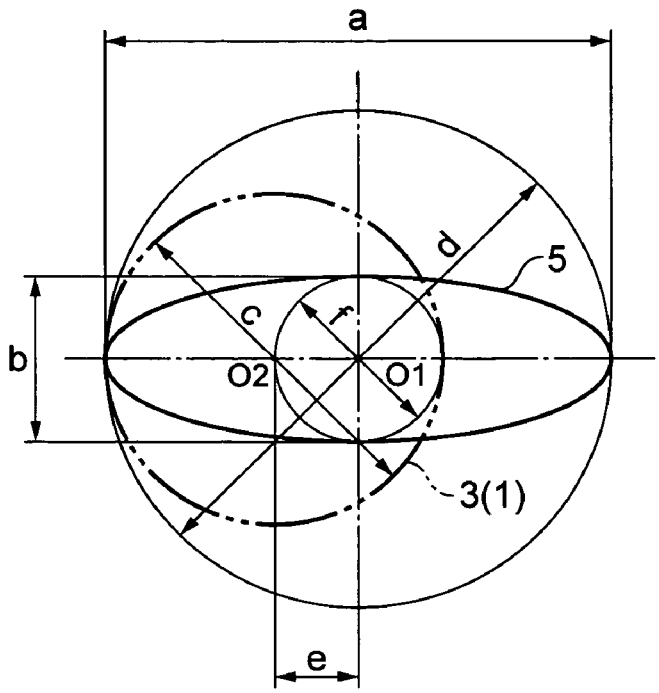
FIGS. 4A and 4B are top views schematically illustrating the relationship of the polishing position between the elastic polishing tool and the spectacle lens.
Figure 4B:
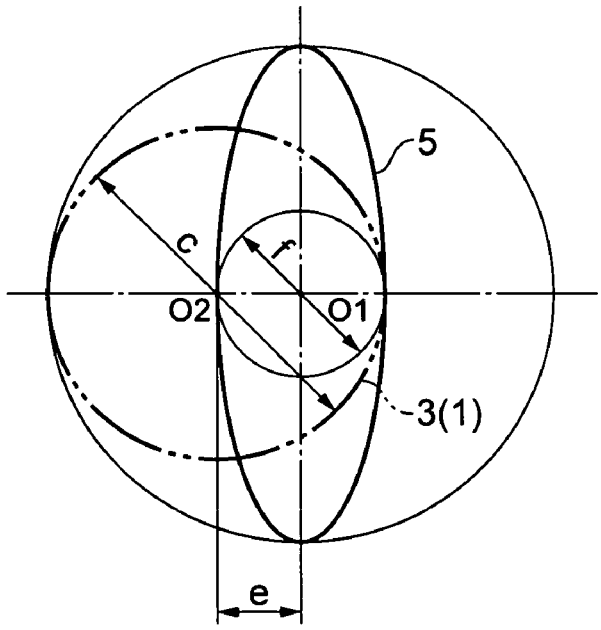

FIG. 4A shows the polishing state of the spectacle lens at the outmost diameter position, and FIG. 4B shows a state in which the spectacle lens is rotated from the position shown in FIG. 4A by an angle of 90°, that is, the polishing state of the spectacle lens at the shortest diameter position. FIGS. 4A and 4B show the relative position between a rotation center O1 of the spectacle lens 5 and the elastic polishing tool 1 (the elastic polishing body 3).

The spectacle lens 5, which is a polishing target, is moved relative to the elastic polishing tool 1 (the elastic polishing body 3) by the rocking operation of the spectacle lens 5 (the chuck of the polishing machine).

In FIG. 4A, the polishing process is performed in a state in which a moving distance e from a rotation center O2 of the elastic polishing body 3 and the rotation center O1 of the spectacle lens 5 is set to be smaller than half the short diameter b (shortest diameter f) of the substantially elliptical shape from the rotation center O1 of the spectacle lens 5. That is, the polishing process is performed in a state in which the moving range is set within the shortest diameter f. In this case, a diameter c of the elastic polishing body 3 is determined on the basis of the following expression: 'the long diameter a (outmost diameter d) of the substantially elliptical portion of the spectacle lens 5>the diameter c of the elastic polishing body 3≧the long diameter a (outmost diameter d) of the substantially elliptical portion of the spectacle lens 5−the short diameter b (shortest diameter f) of the substantially elliptical portion of the spectacle lens 5'.

Further, the shortest diameter f indicates the diameter of a circle having, as a radius, a length from the rotation center O1 of the spectacle lens 5 to the outmost position of the outward shape (the outline of an outer circumferential portion) thereof in the case of the spectacle lens 5 having the substantially elliptical outward shape. Similarly, the outmost diameter d indicates the diameter of a circle having, as a radius, a length from the rotation center O1 of the spectacle lens 5 to the outmost position of the outward shape thereof.

That is, in the polishing method of the spectacle lens 5, the polishing process is performed in a circular region in which the rotation center O2 of the elastic polishing body 3 comes into contact with the spectacle lens 5, without moving the rotation center O2 of the elastic polishing body 3 from the rotation center O1 of the spectacle lens 5 to the outside of the outmost diameter of the outward shape of the spectacle lens 5.

As an example of this process, a process of polishing the substantially elliptical portion of the spectacle lens 5 having a diameter a (outmost diameter d) of 60 mm and a short diameter b (shortest diameter f) of 20 mm will be described with reference to FIGS. 4A and 4B.

The outer diameter c of the elastic polishing body 3 is smaller than 60 mm, which is the long diameter a of the spectacle lens 5. For example, the elastic polishing body 3 having an outer diameter of 40 mm, which is obtained by subtracting the short diameter b (20 mm) of the substantially elliptical portion of the spectacle lens 5 from the long diameter a (60 mm) of the spectacle lens 5, is used. In addition, the polishing process is performed in a state in which the moving distance e of the rotation center O2 of the elastic polishing body 3 from the rotation center O1 of the spectacle lens 5 is set to be smaller than half the short diameter b (20 mm) of the substantially elliptical portion of the spectacle lens 5, for example, 10 mm. That is, the moving distance of the rotation center of the elastic polishing tool that is moved relative to the spectacle lens is set to 20 mm.

Further, the elastic polishing body 3 (the elastic polishing tool 1) having a curvature radius smaller than the average curvature radius of the surface 5*a* to be polished of the spectacle lens 5 and closest to the curvature radius of the surface 5*a* is selected, and the polishing process is performed in a state in which the selected elastic polishing body 3 comes into contact with the surface 5*a* to be polished.

Next, a method of setting the dimensions of the outmost diameter d and the shortest diameter f will be described below.

Figure 5A:
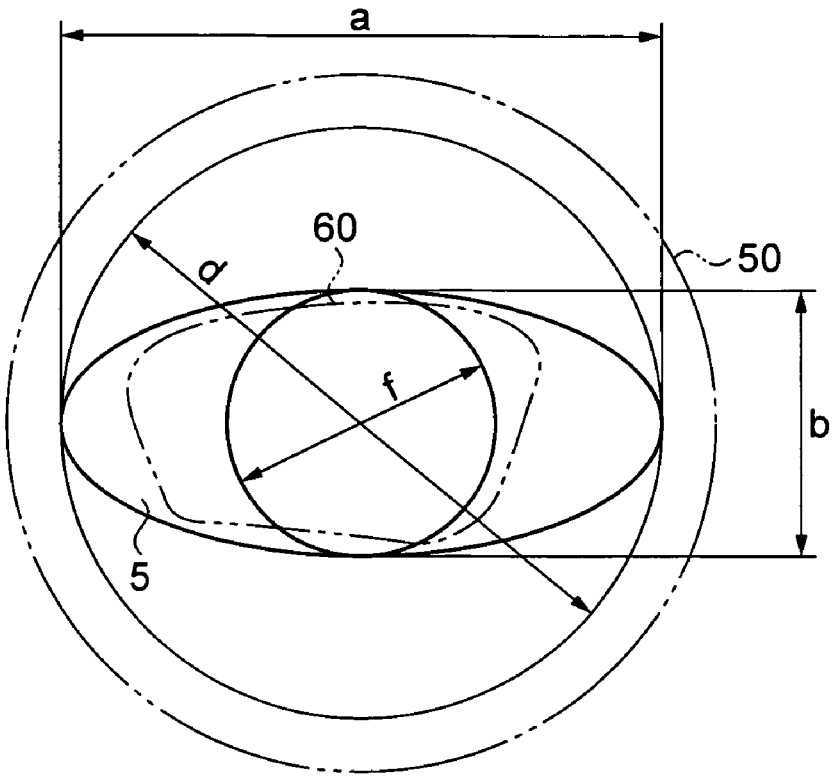
FIG. 5A is a top view schematically illustrating the shape of the spectacle lens in a shaping process.
Figure 5B:
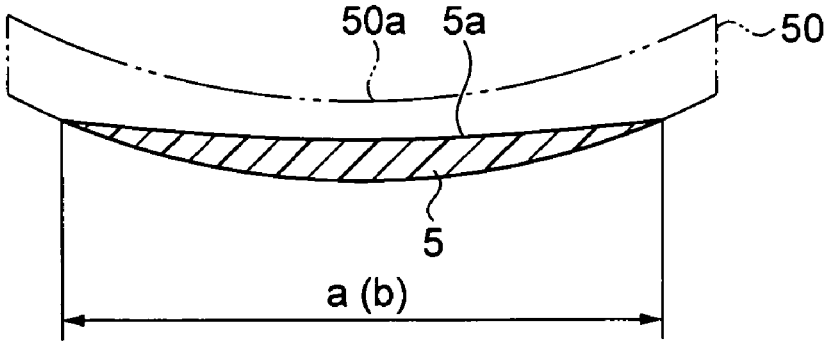
FIG. 5B is a schematic cross-sectional view of the spectacle lens shown in FIG. 5A.
Figure 6:
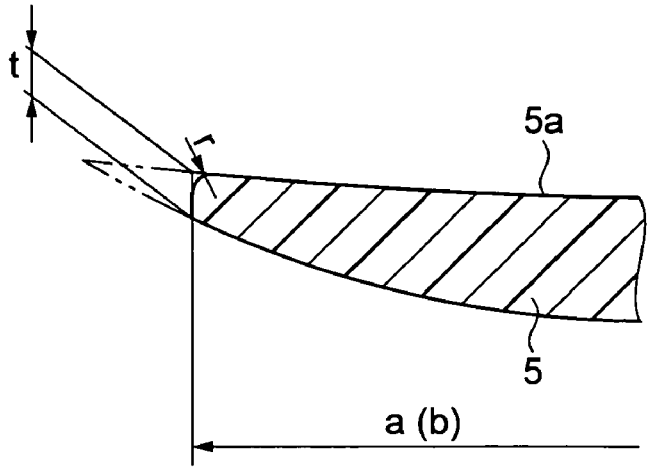
FIG. 6 is a partial cross-sectional view of an outer circumferential portion of the spectacle lens.

FIG. 5A is a top view schematically illustrating a spectacle lens during a shaping process, and FIG. 5B is a schematic cross-sectional view of FIG. 5A. FIG. 6 is a partial cross-sectional view of an outer circumferential portion of the spectacle lens.

In FIGS. 5A and 5B, a semifinished lens (which is represented by a two-dot chain line in FIGS. 5A and 5B) 50 having a convex surface with an optical characteristic and an outer circumferential portion with a circular outline (outward shape) is used as the spectacle lens 5. A shaping surface 50*a* of the concave surface of the semifinished lens 50 is cut or polished to form a surface 5*a* to be polished having a predetermined aspherical shape (hereinafter, referred to as a spherical shape). The cutting of the shaping process causes the outline (outward shape) of the outer circumferential portion of the spectacle lens 5 to be changed from a circular shape into a substantially elliptical shape composed of, for example, the long diameter a and the short diameter b.

In the shaping process, the surface shape to be formed (the shape of the surface 5*a* to be formed) is calculated on the basis of a prescription by, for example, a computer. Then, the outward shape of the spectacle lens 5 after the shaping process is calculated on the basis of the calculated surface shape and spectacle frame data. The calculating process of the outward shape is performed on the basis of a shape 60 of an inner circumferential portion of the spectacle frame represented by a two-dot chain line (that is, the shape of the surface 5*a* formed by lens processing after the surface 5*a* is polished) and the thickness of the central part of the lens after the lens is formed in a desired shape.

In the calculating process of the outward shape of the spectacle lens 5, the outward shape (substantially elliptical shape) of the spectacle lens 5 in which the thickness of a thinnest part of the outline of the outer circumferential portion after the shaping process is zero is calculated on the basis of the formed surface shape. Then, the long diameter a (the outmost diameter d) and the short diameter b (the shortest diameter f) are calculated on the basis of the calculated outward shape.

In addition to the case in which the thickness of the thinnest part of the outline of the outer circumferential portion of the spectacle lens 5 is zero, as shown in the partial cross-sectional view of the outer circumferential portion of the spectacle lens of FIG. 6, it is preferable to calculate the outward shape when the thinnest part of the outline of the outer circumferential portion has a thickness t larger than zero and about 2 mm. The values of the long diameter a (the outmost diameter d) and the short diameter b (the shortest diameter f) are calculated on the basis of the calculated outward shape, and a chamfering process, such as an R chamfering process or a C chamfering process, is preferably performed on an outer circumferential edge formed by the outline of the outer circumferential portion and the formed surface 5*a*. FIG. 6 shows the spectacle lens 5 with a chamfered surface r obtained by performing the R chamfering process on the outer circumferential edge.

The chamfering process performed on the outer circumferential edge makes it possible to prevent a processing agent from being collected in depressions formed by burrs of the outer circumferential edge of the spectacle lens 5 (the surface 5*a* to be polished) when a surface treatment is performed on the polished surface 5*a* of the spectacle lens 5 to prevent scratches from occurring thereon. In addition, it is also possible to prevent the outer circumferential edge from being dug into the polishing pad 4 when the surface 5*a* is polished.

The chamfering process can be simultaneously performed with the shaping process. In addition, in order to decrease the thickness of the central portion of the lens in the shape 60 of the inner circumferential portion of the spectacle lens as small as possible, the thickness t of the thinnest part of the outline of the outer circumferential portion is preferably about 2 mm.

Further, the shortest diameter f and the outmost diameter d of the substantially elliptical portion may be obtained by actual measurement after the shaping process.

Then, the value of the diameter D of the elastic polishing body 3 is determined on the basis of the values of the long diameter a (the outmost diameter d) and the short diameter b (the shortest diameter f). The surface 5*a* of the shaped spectacle lens 5 is polished by the above-mentioned polishing method, thereby forming a lens surface having a predetermined optical characteristic.

Thereafter, a surface treatment, such as an anti-scratch treatment, is performed on the surface of the spectacle lens 5, and then a lens process is performed thereon to rub the edge of the lens according to the inner circumferential shape of the spectacle frame. Then, the processed lens is fitted to the spectacle frame, thereby completing a spectacle.

According to this polishing method, the polishing pad 4 attached to the curved surface 31 of the elastic polishing body 3 opposite to the surface 5*a* to be polished is set to have a diameter which is 1.01 to 1.60 times the length of the arc AB of the elastic polishing body shown in the cross section including the central axis of the cylindrical portion of the elastic polishing body 3. Therefore, the polishing pad 4 is attached to the elastic polishing body 3 so as to cover the entire surface of the curved surface 31 including the edge of the elastic polishing body 3, which causes the curved surface 31 of the elastic polishing body 31 not to be exposed. In this way, when the elastic polishing tool 1 scans the entire surface of the surface 5*a* to be polished of the spectacle lens 5, the polishing processing can be performed while preventing the polishing pad 4 from peeling off due to the edge of the spectacle lens 5 dug into the polishing pad 4 or preventing the damage of the elastic polishing tool 1 and the spectacle lens 5 to be polished.

The diameter of the polishing pad 4 is obtained by the following expression: '(the length of the arc AB of the elastic polishing body 3+the length C of the cylindrical portion of the elastic polishing body 3×4.00)≧the diameter D of the polishing pad 4≧(the length of the arc AB of the elastic polishing body 3+the length C of the cylindrical portion of the elastic polishing body 3×0.05). Therefore, when the elastic polishing tool 1 comes into contact with the surface 5*a* to be polished of the spectacle lens 5 at predetermined pressure to perform a polishing process, the polishing process can be performed with a high degree of efficiency, without raising the following problem: the elastic polishing body 3 is pressed down to bring the edge of the polishing body base 2 into contact with the surface 5*a* to be polished, which results in the occurrence of scratches in the surface 5*a* to be polished. In addition, the length of the arc AB of the elastic polishing body 3 is the length of an arc of the elastic polishing body shown in the cross section including the rotating shaft of the elastic polishing tool, that is, the length of an arc shown in the cross section including the central axis O of the cylindrical portion of the elastic polishing body 3.

Furthermore, even when the outline (outward shape) of the outer circumferential portion of the spectacle lens 5 having the surface to be polished has a circular shape (not shown), the circular semifinished lens 50 (see FIG. 5) makes it possible to obtain the same effects as those obtained when the outline has the substantially elliptical shape. In the above description, even when the formed spectacle lens has a circular outward shape, the spectacle lens and the surface to be polished thereof are also represented by the spectacle lens 5 and the surface 5*a* to be polished.

Moreover, since the rotation center O2 of the elastic polishing body 3 moves between the rotation center O1 of the spectacle lens 5 and the shortest diameter f of the outward shape of the spectacle lens 5, it is possible to prevent the polishing pad 4 from peeling off due to the outer circumferential portion of the spectacle lens 5, which is a polishing target, being dug into the polishing pad 4 attached to the surface of the elastic polishing body 3, or to prevent the damage of the elastic polishing body 3 and the spectacle lens 5, which is a polishing target, due to the peeling of the polishing pad 4.

Further, the elastic polishing body 3 (the elastic polishing tool 1) having a diameter smaller than that of the spectacle lens 5 and a curvature radius smaller than the average curvature radius of the surface 5*a* to be polished of the spectacle lens 5 and closest to the curvature radius of the surface 5*a* to be polished is selected, and the polishing process is performed in a state in which substantially the entire surface of the elastic polishing body 3 comes into contact with the surface 5*a* to be polished. Therefore, it is possible to perform mirror polishing without polishing irregularity, while maintaining a predetermined aspherical shape.

Furthermore, the surface shape of the spectacle lens 5 and the outward shape of the spectacle lens 5 are calculated, and the surface 5*a* to be polished is shaped on the basis the calculated outward shape and is then polished, which makes it possible to obtain the spectacle lens 5 having a small thickness at the center. In addition, in the calculated outward shape of the spectacle lens 5, the thinnest part of the outline of the outer circumferential portion of the shaped surface 5*a* to be polished has a thickness larger than zero and smaller than 2 mm. Therefore, it is possible to perform chamfering on the outer circumferential edge formed by the outline of the outer circumferential portion of the spectacle lens 5 and the shaped surface 5*a* to be polished. When a surface treatment, such as an anti-scratch treatment, is performed on the polished surface 5*a* of the spectacle lens 5, it is possible to prevent a processing agent from being collected in depressions at the outer circumferential edge of the spectacle lens 5.

In the above-mentioned polishing method of this embodiment, the spectacle lens 5 rocks on the elastic polishing tool 1 (the surface of the polishing pad 4 attached to the curved surface 31 of the elastic polishing body 3) while the spectacle lens 5 and the elastic polishing tool 1 are being rotated. However, the invention may be applied to a polishing machine (polishing method) in which the elastic polishing tool 1 rocks the surface 5*a* to be polished of the spectacle lens 5.

Further, in this embodiment, the concave surface of the spectacle lens 5, which is a polishing target, is polished by using the elastic polishing tool 1 having a dome-shaped curved surface formed therein. However, the invention can be similarly applied to a case in which a material having a concave surface, which is a polishing target, is polished by using the elastic polishing tool 1 having a crater-shaped curved surface formed therein.

Furthermore, in this embodiment, a plastic spectacle lens is used. However, the invention can be applied to any optical element required to be planarized or required for mirror polishing. For example, the invention can be applied to various optical lenses, a glass mold for cast-polymerizing a plastic lens, an optical lens, made of glass, including a spectacle lens, and an optical component, such as a mold for forming the optical lens, in addition to the plastic spectacle lens.

Hereinafter, examples and comparative examples are will be described on the basis of this embodiment.

The examples and comparative examples are divided into first to ninth examples and first to fourth comparative examples related to the polishing pad, twenty-first to twenty-third examples and twenty-first and twenty-second comparative examples related to the elastic polishing body and the polishing method.

1. EXAMPLES AND COMPARATIVE EXAMPLES RELATED TO POLISHING PAD

FIRST EXAMPLE

A polishing process is performed on a circular spectacle lens 5, which is a polishing target, having a diameter of 75 mm and a surface 5*a* to be polished with an average curvature radius of 120 mm.

An elastic polishing body 3 having a diameter of 40 mm, a curved surface 31 with a curvature radius R of 100 mm, and a cylindrical portion with a length C of 6.00 mm is selected as the elastic polishing tool 1. The length of an arc AB shown in the cross section including a central axis O of the cylindrical portion of the elastic polishing body 3 (that is, the length of the arc AB in the cross section including a rotating shaft of the elastic polishing tool 1) is 40.27 mm. A circular polishing pad 4 having a diameter of 42.0 mm, which is larger than the length of the arc AB of the elastic polishing body 3 by 1.73 mm, is prepared as a polishing pad. The prepared polishing pad 4 is adhered to the curved surface 31 of the elastic polishing body 3 opposite to the surface 5*a* to be polished of the spectacle lens 5, with the central axis of the prepared polishing pad 4 substantially coinciding with the central axis of the cylindrical portion of the elastic polishing body 3.

That is, the polishing pad 4 used in the first example has a diameter which is 1.04 times the length of the arc AB of the elastic polishing body 3. In addition, the polishing pad 4 has, as a diameter, the value obtained by the following expression: the length of the arc AB of the elastic polishing body 3+the length C of the cylindrical portion of the elastic polishing body 3×0.28.

Further, a pressure of 0.1 MPa is applied to the elastic polishing tool 1, and the number of rotations of the elastic polishing tool 1 is set to 1400 rpm. Meanwhile, the spectacle lens 5 to be polished is rotated at 500 rpm, and rocks at the rate of one reciprocation every ten seconds. In this way, the polishing process is performed for two minutes.

The spectacle lens 5 having the polished surface 5*a* is referred to as a first test sample.

Second Example

Polishing is performed under the same conditions as those in the first example except polishing pads, using the same elastic polishing bodies 3 as that in the first example.

Four types of circular polishing pads 4 are used as the polishing pads: that is, a first circular polishing pad having a diameter of 41.0 mm, which is larger than the length of the arc AB of the elastic polishing body 3 by 0.73 mm; a second circular polishing pad having a diameter of 44.0 mm, which is larger than the length of the arc AB of the elastic polishing body 3 by 3.73 mm; a third circular polishing pad having a diameter of 48.0 mm, which is larger than the length of the arc AB of the elastic polishing body 3 by 7.73 mm; and a fourth circular polishing pad having a diameter of 52.0 mm, which is larger than the length of the arc AB of the elastic polishing body 3 by 11.73 mm.

That is, the polishing pads 4 used in the second example respectively have diameters which are 1.02 times, 1.09 times, 1.19 times, and 1.29 times the length of the arc AB of the elastic polishing body 3. In addition, the polishing pads have, as diameters, four values obtained by the following expression: the length of the arc AB of the elastic polishing body 3+the length C of the cylindrical portion of the elastic polishing body 3×0.12, 0.62, 1.29, and 1.95.

The spectacle lenses having the polished surfaces 5*a* are referred to as second to fifth test samples in the order of the diameters of the polishing pad 4 used for the polishing. For example, the spectacle lens 5 having the surface 5*a* polished by the polishing pad 4 with the smallest diameter is referred to as the second test example.

Third Example

Polishing is performed under the same conditions as those in the first example except a polishing pad, using the same elastic polishing body 3 as that in the first example.

Figure 7:
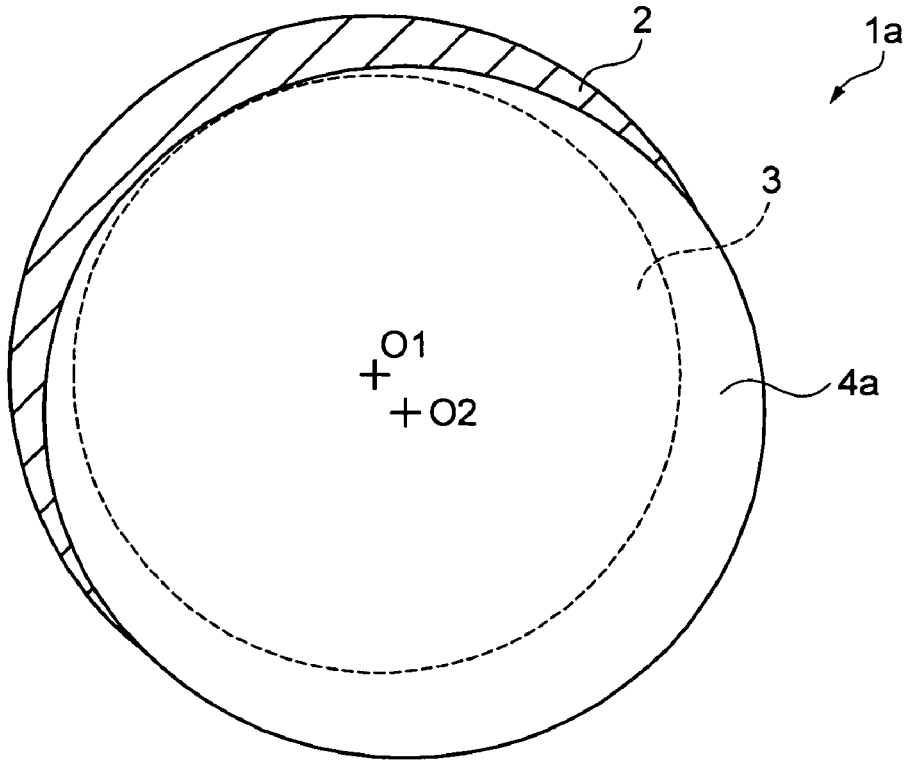
FIG. 7 is a top view of an elastic polishing tool used for a polishing process according to a third example.

A circular polishing pad 4*a* having a diameter of 44.0 mm, which is larger than the length of the arc AB of the elastic polishing body 3 by 3.73 mm, is prepared as the polishing pad 4. As shown in the top view of the elastic polishing tool of FIG. 7, the prepared polishing pad 4*a* is adhered to the curved surface 31 of the elastic polishing body 3 so as to cover the entire surface thereof, with a central axis O2 of the polishing pad 4*a* eccentric to a central axis O1 of the elastic polishing body 3, thereby constituting an elastic polishing tool 1*a*.

That is, the polishing pad 4*a* used in the third example has a diameter which is 1.09 times the length of the arc AB of the elastic polishing body 3. In addition, the polishing pad 4*a* has, as a diameter, the value obtained by the following expression: the length of the arc AB of the elastic polishing body 3+the length C of the cylindrical portion of the elastic polishing body 3×0.62. In the following description, the polishing pad 4*a* may be referred to as the polishing pad 4.

The spectacle lens 5 having the polished surface 5*a* is referred to as a sixth test sample.

Fourth Example

Polishing is performed under the same conditions as those in the first example except a polishing pad, using the same elastic polishing body 3 as that in the first example.

Figure 8:
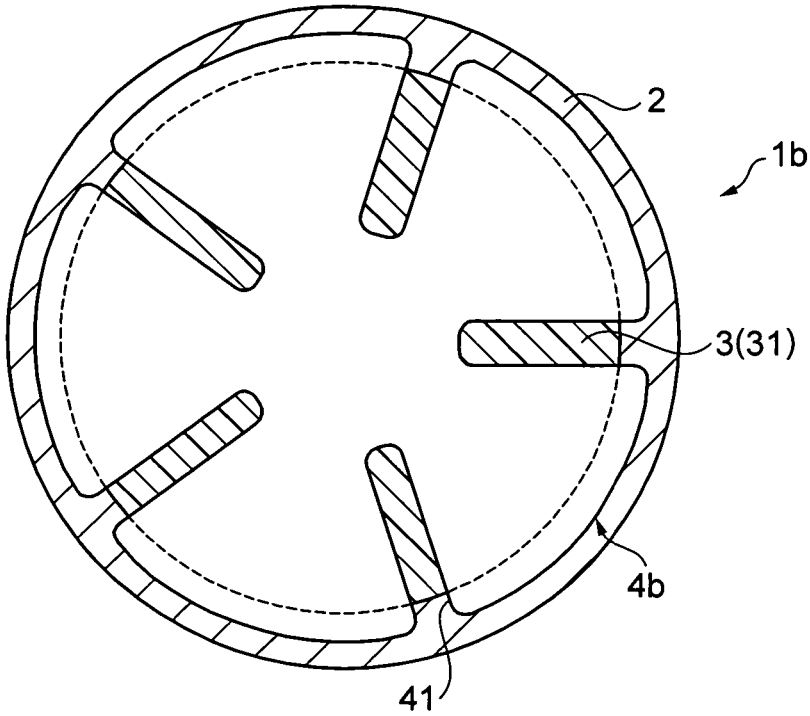
FIG. 8 is a top view of an elastic polishing tool used for a polishing process according to a fourth example.

As shown in the top view of an elastic polishing tool 1*b* of FIG. 8, a petal-shaped polishing pad 4*b* having a plurality of cut-out portions 41 (in this example, five cut-out portions) radially arranged on the circular polishing pad is prepared as the polishing pad 4. The polishing pad 4*b* has a diameter of 44.0 mm, which is larger than the length of the arc AB of the elastic polishing body 3 by 3.73 mm.

Further, the prepared polishing pad 4*b* is adhered to the curved surface 31 of the elastic polishing body 3 so as to cover the surface thereof with the central axis thereof substantially coinciding with the central axis O of the elastic polishing body 3, thereby constituting the elastic polishing tool 1*b*. The petal-shaped cut-out portions 41 radially arranged on the polishing pad 4*b* functions as a passage for supplying the slurry 9 and for discharging polishing powder at the time of polishing.

That is, the polishing pad 4*b* used in the fourth example has a diameter which is 1.09 times the length of the arc AB of the elastic polishing body 3. In addition, the polishing pad 4*b* has, as a diameter, the value obtained by the following expression: the length of the arc AB of the elastic polishing body 3+the length C of the cylindrical portion of the elastic polishing body 3×0.62. In the following description, the polishing pad 4*b* may be referred to as the polishing pad 4.

The spectacle lens 5 having the polished surface 5*a* is referred to as a seventh test sample.

Fifth Example

Polishing is performed under the same conditions as those in the first example except a polishing pad, using the same elastic polishing body 3 as that in the first example.

Figure 9:
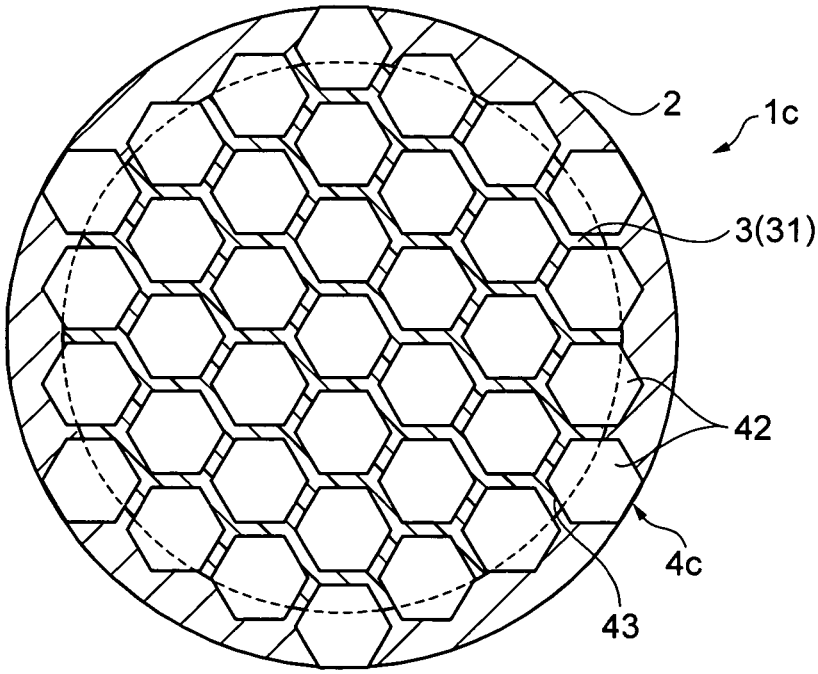
FIG. 9 is a top view of an elastic polishing tool used for a polishing process according to a fifth example.

As shown in the top view of an elastic polishing tool 1*c* of FIG. 9, a plurality of polygonal (in this example, a regular hexagon) pads 42 are adhered to the surface 31 of the elastic polishing body 3 so as to cover the surface 31, with sides of the pads 42 close to each other, thereby forming a polishing pad 4*c*. The elastic polishing body 3 and the polishing pad 4*c* constitute the elastic polishing tool 1*c*. In addition, the curved surface 31 of the elastic polishing body 3 is exposed through gaps between the plurality of pads 42, and the gaps between the pads 42 function as water flow passages 43 for supplying the slurry 9 and for discharging polishing powder.

When a length between the central axis of the elastic polishing body 3 and a portion of the outmost one of the plurality of pads 42 furthest away from the central axis is referred to as the diameter of the polishing pad 4*c*, the polishing pad 4*c* has a diameter of 48.0 mm, which is larger than the length of the arc AB of the elastic polishing body 3 by 7.73 mm. That is, the polishing pad 4*c* used in the fifth example has a diameter which is 1.19 times the length of the arc AB of the elastic polishing body 3. In addition, the polishing pad 4*c* has, as a diameter, the value obtained by the following expression: the length of the arc AB of the elastic polishing body 3+the length C of the cylindrical portion of the elastic polishing body 3×1.29. In the following description, the polishing pad 4*c* may be referred to as the polishing pad 4.

The spectacle lens 5 having the polished surface 5*a* is referred to as an eighth test sample.

Sixth Example

A polishing process is performed on a spectacle lens 5, which is a polishing target, having a substantially elliptical shape, a surface 5*a* to be polished with an average curvature radius of 120 mm, and a sharp circumferential portion. A length from a lens center O1 of the polished spectacle lens 5 to an outer circumferential portion thereof is set in a range of 35 (the minimum value, that is, an outmost diameter d of 80 mm) to 40 mm (the maximum value, that is, a shortest diameter f of 70 mm).

An elastic polishing body 3 having a diameter D of 40 mm, a curvature radius R of 100 mm, an arc AB with a length of 40.27 mm, and a cylindrical portion with a length C of 6.00 mm is prepared, similar to the first example. A circular polishing pad 4 having a diameter of 64.27 mm, which is larger than the length of the arc AB of the elastic polishing body 3 by 24.00 mm, is prepared as a polishing pad. The prepared polishing pad 4 is adhered to the curved surface 31 of the elastic polishing body 3 with the central axis of the prepared polishing pad 4 substantially coinciding with the central axis of the elastic polishing body 3, thereby constituting the elastic polishing tool 1.

Further, a pressure of 0.08 MPa is applied to the elastic polishing tool 1, and the number of rotations of the elastic polishing tool 1 is set to 1400 rpm. Meanwhile, the spectacle lens 5 (chuck) is rotated at 500 rpm, and rocks at the rate of one reciprocation every ten seconds. In this way, the polishing process is performed for two minutes.

That is, the polishing pad 4 used in the sixth example has a diameter which is 1.60 times the length of the arc AB of the elastic polishing body 3. In addition, the polishing pad 4 has, as a diameter, the value obtained by the following expression: the length of the arc AB of the elastic polishing body 3+the length C of the cylindrical portion of the elastic polishing body 3×4.00.

The spectacle lens 5 having the polished surface 5*a* is referred to as a ninth test sample.

Seventh Example

Polishing is performed on the spectacle lens 5 under the same conditions as those in the sixth example except a polishing pad, using the same elastic polishing body 3 as that in the sixth example.

A circular polishing pad 4 having a diameter of 40.57 mm, which is larger than the length of the arc AB of the elastic polishing body 3 by 0.30 mm, is prepared as a polishing pad. That is, the polishing pad 4 used in the seventh example has a diameter which is 1.01 times the length of the arc AB of the elastic polishing body 3. In addition, the polishing pad 4 has, as a diameter, the value obtained by the following expression: the length of the arc AB of the elastic polishing body 3+the length C of the cylindrical portion of the elastic polishing body 3×0.05.

The spectacle lens 5 having the polished surface 5*a* is referred to as a tenth test sample.

Eighth Example

Polishing is performed on the spectacle lens 5 under the same conditions as those in the sixth example except a polishing pad and an elastic polishing body.

An elastic polishing body 3 having a diameter D of 40 mm, a curvature radius R of 100 mm, an arc AB with a length of 40.27 mm, and a cylindrical portion with a length C of 10.00 mm is prepared as an elastic polishing body. A circular polishing pad 4 having a diameter of 60.27 mm, which is larger than the length of the arc AB of the elastic polishing body 3 by 20.00 mm, is prepared as a polishing pad. That is, the polishing pad 4 used in the eighth example has a diameter which is 1.50 times the length of the arc AB of the elastic polishing body 3. In addition, the polishing pad 4 has, as a diameter, the value obtained by the following expression: the length of the arc AB of the elastic polishing body 3+the length C of the cylindrical portion of the elastic polishing body 3×2.00.

The spectacle lens 5 having the polished surface 5*a* is referred to as an eleventh test sample.

Ninth Example

Polishing is performed on a spectacle lens 5 under the same conditions as those in the sixth example except a polishing pad and an elastic polishing body.

More specifically, the polishing is performed on the spectacle lens 5, which is a polishing target, having a circular outward shape and a surface 5*a* to be polished with an average curvature radius of 120 mm. A length from the center of the spectacle lens 5 to an outer circumferential portion thereof is 40 mm (that is, an outer diameter of 80 mm).

An elastic polishing body 3 having a diameter D of 40 mm, a curvature radius R of 100 mm, and a cylindrical portion with a length C of 6.00 mm is prepared as an elastic polishing body, similar to the sixth example. A circular polishing pad 4 having a diameter of 40.57 mm, which is larger than the length of the arc AB of the elastic polishing body 3 by 0.30 mm, is prepared as a polishing pad. The polishing pad 4 is adhered to the curved surface 31 of the elastic polishing body 3 with the central axis of the prepared polishing pad 4 substantially coinciding with the central axis of the elastic polishing body 3. That is, the polishing pad 4 used in the ninth example has a diameter which is 1.01 times the length of the arc AB of the elastic polishing body 3. In addition, the polishing pad 4 has, as a diameter, the value obtained by the following expression: the length of the arc AB of the elastic polishing body 3+the length C of the cylindrical portion of the elastic polishing body 3×0.05.

The spectacle lens 5 having the polished surface 5*a* is referred to as a twelfth test sample.

First Comparative Example

Polishing is performed on a spectacle lens 5 under the same conditions as those in the first example except a polishing pad, using the same elastic polishing body 3 as that in the first example.

A circular polishing pad 4 having a diameter of 40.0 mm, which is smaller than the length of the arc AB of the elastic polishing body 3 by 0.27 mm, is prepared as a polishing pad. The prepared polishing pad 4 is adhered to the curved surface 31 of the elastic polishing body 3, with the central axis of the polishing pad 4 coinciding with the central axis of the elastic polishing body 3, thereby constituting an elastic polishing tool 1. That is, the polishing pad 4 used in the first comparative example has a diameter which is 0.99 times the length of the arc AB of the elastic polishing body 3. In addition, the polishing pad 4 has, as a diameter, the value obtained by the following expression: the length of the arc AB of the elastic polishing body 3+the length C of the cylindrical portion of the elastic polishing body 3×0.04.

The spectacle lens 5 having the polished surface 5*a* is referred to as a thirteenth test sample.

Second Comparative Example

Polishing is performed on the spectacle lens 5 under the same conditions as those in the sixth example except a polishing pad, using the same elastic polishing body as that in the sixth example.

A circular polishing pad 4 having a diameter of 40.51 mm, which is larger than the length of the arc AB of the elastic polishing body 3 by 0.24 mm, is prepared as a polishing pad. That is, the polishing pad 4 used in the second comparative example has a diameter which is 1.01 times the length of the arc AB of the elastic polishing body 3. In addition, the polishing pad 4 has, as a diameter, the value obtained by the following expression: the length of the arc AB of the elastic polishing body 3+the length C of the cylindrical portion of the elastic polishing body 3×0.04.

The spectacle lens 5 having the polished surface 5*a* is referred to as a fourteenth test sample.

Third Comparative Example

Polishing is performed on the spectacle lens 5 under the same conditions as those in the eighth example except a polishing pad, using the same elastic polishing body as that in the eighth example.

An elastic polishing body 3 having a diameter D of 40 mm, a curvature radius R of 100 mm, an arc AB with a length of 40.27 mm, and a cylindrical portion with a length C of 10.00 mm is prepared as an elastic polishing body. A circular polishing pad 4 having a diameter of 40.67 mm, which is larger than the length of the arc AB of the elastic polishing body 3 by 0.40 mm, is prepared as a polishing pad. That is, the polishing pad 4 used in the third comparative example has a diameter equal to the length of the arc AB of the elastic polishing body 3. In addition, the polishing pad 4 has, as a diameter, the value obtained by the following expression: the length of the arc AB of the elastic polishing body 3+the length C of the cylindrical portion of the elastic polishing body 3×0.04.

The spectacle lens 5 having the polished surface 5*a* is referred to as a fifteenth test sample.

Fourth Comparative Example

Polishing is performed on the spectacle lens 5 under the same conditions as those in the ninth example except a polishing pad, using the same spectacle lens 5 and elastic polishing body as those in the ninth example.

More specifically, the polishing is performed on a spectacle lens 5, which is a polishing target, having a circular outward shape and a surface 5*a* to be polished with an average curvature radius of 120 mm. A length from the center of the spectacle lens 5 to an outer circumferential portion thereof is 40 mm (that is, an outer diameter of 80 mm). A circular polishing pad 4 having a diameter of 40.51 mm, which is larger than the length of the arc AB of the elastic polishing body 3 by 0.24 mm, is used as a polishing pad. That is, the polishing pad 4 used in the fourth comparative example has a diameter equal to the length of the arc AB of the elastic polishing body 3. In addition, the polishing pad 4 has, as a diameter, the value obtained by the following expression: the length of the arc AB of the elastic polishing body 3+the length C of the cylindrical portion of the elastic polishing body 3×0.04.

The spectacle lens 5 having the polished surface 5*a* is referred to as a sixteenth test sample.

The appearance qualities (scratches) the polished surfaces 5*a* of the spectacle lenses 5 obtained from the first to ninth examples (the first to twelfth test examples) and the first to fourth comparative examples (the thirteenth to sixteenth test examples) are examined with the naked eye. The examination results are shown in Table 1, associated with the specifications in shape of the polishing pad 4 and the elastic polishing body 3 used for polishing. In Table 1, the appearance qualities are determined by good and poor marks 'O' and 'X'.

TABLE 1

| | Test sample No. | Outward shape of lens | Specifications of polishing pad: Shape | Specifications of polishing pad: Diameter (mm) | Elastic polishing body: Diameter of cylindrical portion (mm) | Elastic polishing body: Multiplier to length of cylindrical portion | Diameter of polishing pad/length of arc AB of elastic polishing body | Quality of appearance | Result |
|---|---|---|---|---|---|---|---|---|---|
| Example 1 | Test sample 1 | Circular shape | Circular shape | 42.0 | 6.00 | 0.29 | 1.04 | No defect | ○ |
| Example 2 | Test sample 2 | ↑ | ↑ | 41.0 | ↑ | 0.12 | 1.02 | ↑ | ○ |
| | Test sample 3 | ↑ | ↑ | 44.0 | ↑ | 0.62 | 1.09 | ↑ | ○ |
| | Test sample 4 | ↑ | ↑ | 48.0 | ↑ | 1.29 | 1.19 | ↑ | ○ |
| | Test sample 5 | ↑ | ↑ | 52.0 | ↑ | 1.96 | 1.29 | ↑ | ○ |
| Example 3 | Test sample 6 | ↑ | Circular shape (eccentric circle) | 44.0 | ↑ | 0.62 | 1.09 | ↑ | ○ |
| Example 4 | Test sample 7 | ↑ | Petal shape | ↑ | ↑ | ↑ | ↑ | ↑ | ○ |
| Example 5 | Test sample 8 | ↑ | Aggregate of polygonal polishing pads | 48.0 | ↑ | 1.29 | 1.19 | ↑ | ○ |
| Example 6 | Test sample 9 | Substantially elliptical shape | Circular shape | 64.27 | ↑ | 4.00 | 1.60 | ↑ | ○ |
| Example 7 | Test sample 10 | ↑ | ↑ | 40.57 | ↑ | 0.05 | 1.01 | ↑ | ○ |
| Example 8 | Test sample 11 | ↑ | ↑ | 64.27 | 10.00 | 2.00 | 1.50 | ↑ | ○ |
| Example 9 | Test sample 12 | Circular shape | ↑ | 40.57 | 6.00 | 0.05 | 1.01 | ↑ | ○ |
| Comp. example 1 | Test sample 13 | ↑ | ↑ | 40.0 | ↑ | −0.05 | 0.99 | Polishing scratches | x |
| Comp. example 2 | Test sample 14 | Substantially elliptical shape | ↑ | 40.51 | ↑ | 0.04 | 1.01 | Damage of elastic polishing body and lens | x |
| Comp. example 3 | Test sample 15 | ↑ | ↑ | 40.67 | 10.00 | ↑ | 1.00 | Polishing scratches | x |
| Comp. example 4 | Test sample 16 | Circular shape | ↑ | 40.51 | 6.00 | ↑ | ↑ | ↑ | x |

As can be seen from Table 1, in the range in which the diameter of the polishing pad 4 is larger than the length of the arc AB of the elastic polishing body 3 shown in the cross section including the rotation axis of the elastic polishing body by a length of 0.73 to 24.00 mm, that is, is 1.01 to 1.60 times the length of the arc AB of the elastic polishing body 3, regardless of the outline (outward shape) of the outer circumferential portion of the spectacle lens 5 and the shape of the polishing pad 4, mirror polishing can be performed on the entire surface of the surface 5*a* to be polished of the spectacle lens 5 without polishing chips and scratches, which makes it possible to obtain a spectacle lens 5 having high quality in appearance (the first to ninth examples).

Further, the diameter of the polishing pad 4 has a value obtained by adding the value obtained by multiplying the length C of the cylindrical portion of the elastic polishing body by 0.05 to 4.00 to the length of the arc AB of the elastic polishing body 3 shown in the cross section including the rotation axis of the elastic polishing body 3. Therefore, mirror polishing can be performed on the surface 5*a* to be polished of the spectacle lens 5 without polishing chips and scratches, which makes it possible to obtain a spectacle lens 5 having a desired quality in appearance (the first to ninth examples).

Meanwhile, when the diameter of the polishing pad 4 is smaller than the length of the arc AB of the elastic polishing body 3 shown in the cross section including the rotation axis of the elastic polishing body 3, polishing chips does not occur, but a number of arc-shaped polishing scratches which are not allowable in the spectacle lens 5 occur, which makes it difficult to obtain a spectacle lens 5 having a desired quality in appearance (the first comparative example).

Furthermore, in a case in which the diameter of the polishing pad 4 has a value obtained by adding the value obtained by multiplying the length C of the cylindrical portion of the elastic polishing body 3 by 0.04 to the length of the arc AB of the elastic polishing body 3 shown in the cross section including the rotation axis of the elastic polishing body 3, even though the diameter of the polishing pad 4 is 1.01 or more times the length of the arc AB of the elastic polishing body, the edge of a sharp circumferential portion of the spectacle lens 5 having a substantially elliptical shape is dug into the elastic polishing body 3, and thus the spectacle lens 5 and the elastic polishing body 3 are damaged, which makes it difficult to obtain a spectacle lens having a desired quality in appearance (the second comparative example).

Moreover, in both cases in which the diameter of the polishing pad 4 has a value obtained by adding the value obtained by multiplying the length C of the cylindrical portion of the elastic polishing body by 0.04 to the length of the arc AB of the elastic polishing body 3 shown in the cross section including the rotation axis of the elastic polishing body 3, and in which the polishing pad 4 has a diameter equal to the length of the arc AB of the elastic polishing body 3, regardless of the outline (outward shape) of the spectacle lens 5, arc-shaped polishing scratches which are not allowable in the spectacle lens 5 occur in the surface 5*a* to be polished thereof (the second and fourth comparative examples).

Therefore, when the diameter of the polishing pad 4 has a value obtained by adding the value obtained by multiplying the length C of the cylindrical portion of the elastic polishing body by 0.05 to 4.00 to the length of the arc AB of the elastic polishing body 3 shown in the cross section including the rotation axis of the elastic polishing body 3, regardless of the outline (outward shape) of the outer circumferential portion of the spectacle lens 5 and the shape of the polishing pad 4, it is possible to achieve an elastic polishing tool 1 and a lens polishing method capable of preventing the generation of unnecessary scratches and the damage of the spectacle lens 5 and the elastic polishing body 3. When the diameter of the polishing pad 4 is 1.01 to 1.60 times the length of the arc AB of the elastic polishing body shown in the cross section including the rotation axis of the elastic polishing body 3, the same effects as described above can be obtained.

2. EXAMPLES AND COMPARATIVE EXAMPLES RELATED TO ELASTIC POLISHING BODY AND POLISHING METHOD

The following examples and comparative examples relate to elastic polishing bodies and the moving ranges (polishing method) of the elastic polishing bodies. In the following examples and comparative examples, an elastic polishing body 3 having a cylindrical portion with a length C of 6.00 is used as an elastic polishing body, and a circular polishing pad 4 having a diameter which is 1.29 times the length of an arc AB of the elastic polishing body 3 is used as a polishing pad.

Twenty-first Example

Polishing is performed on a spectacle lens 5, which is a polishing target, having a circumferential portion whose outline (outward shape) has a substantially elliptical shape and a sharp edge. A length from a rotation center O1 of the spectacle lens 5 to an outer circumferential portion thereof is in a range of 25 mm (the minimum value; that is, a shortest diameter f of 50 mm) to 40 mm (the maximum value; that is, an outmost diameter d of 80 mm), which is measured before the polishing.

An elastic polishing body 3 having an outer diameter of 40 mm, which is smaller than the outmost diameter d (80 mm) of the spectacle lens 5 and is larger than 30 mm which is obtained by subtracting the shortest diameter f (50 mm) of the spectacle lens 5 from the outer diameter d (80 mm) of the spectacle lens 5, is used as an elastic polishing tool 1.

In addition, the moving distance e of the rotation center O2 of the elastic polishing body 3 (the elastic polishing tool 1), which is moved relative to the spectacle lens 5, from the rotation center O1 of the spectacle lens 5 is set to 25 mm which is the minimum length from the rotation center O1 of the spectacle lens 5 to the outer circumferential portion thereof (that is, the moving range of the rotation center of the elastic polishing tool which is moved relative to the spectacle lens is set to 50 mm). Further, the elastic polishing tool 1 comes into pressure contact with the surface 5*a* to be polished of the spectacle lens 5 with a pressure of 0.1 MPa, and the number of rotations of the elastic polishing tool 1 is set to 1400 rpm. Meanwhile, the spectacle lens 5 is rotated at 500 rpm, and moves on the elastic polishing tool 1 at the rate of one reciprocation every ten seconds. In this way, the polishing process is performed for two minutes.

In the polishing process, since the polishing pad 4 adhered to the elastic polishing body 3 is not peeled off, the spectacle lens 5 has the polished surface 5*a* without polishing chips and scratches. Thus, it is possible to obtain a spectacle lens 5 having a desired quality in appearance.

Twenty-second Example

A circular semifinished lens 50 having an outer diameter of 70 mm is prepared as a material to be polished, and shaping (cutting) and polishing processes are performed thereon. In a step of calculating the aspherical shape of the spectacle lens 5 to be polished before the polishing process, the outward shape of the shaped lens is calculated. According to the calculated outward shape, the length from the rotation center O1 of the spectacle lens 5 to the outer circumferential portion thereof is in a range of 15 mm (the minimum value; that is, a shortest diameter f of 30 mm) to 30 mm (the maximum value; that is, an outmost diameter d of 60 mm), and the edge of the spectacle lens is shape. An elastic polishing body 3 having an outer diameter D of 40 mm, which is smaller than the outmost diameter d (60 mm) of the spectacle lens 5 and is larger than 30 mm which is obtained by subtracting the shortest diameter f (30 mm) of the spectacle lens 5 from the outer diameter d (60 mm) of the spectacle lens 5, is used as an elastic polishing tool 1.

In addition, the moving distance e of the rotation center O2 of the elastic polishing tool 1 (the elastic polishing body 3), which is moved relative to the shaped spectacle lens 5, from the rotation center O1 of the spectacle lens 5 is set to 15 mm which is the minimum length from the rotation center O1 of the spectacle lens 5 to the outer circumferential portion thereof (that is, the moving range of the rotation center of the elastic polishing tool which is moved relative to the spectacle lens is set to 30 mm). Further, the elastic polishing tool 1 comes into pressure contact with the surface 5*a* to be polished of the spectacle lens 5 with a pressure of 0.1 MPa, and the number of rotations of the elastic polishing tool 1 is set to 1400 rpm. Meanwhile, the spectacle lens 5 is rotated at 500 rpm, and moves on the elastic polishing tool 1 at the rate of one reciprocation every ten seconds. In this way, the polishing process is performed for two minutes.

In the polishing process, since the polishing pad 4 adhered to the elastic polishing body 3 is not peeled off, the spectacle lens 5 has the polished surface 5*a* without polishing chips and scratches. Thus, it is possible to obtain a spectacle lens 5 having a desired quality in appearance.

Twenty-third Example

A circular semifinished lens 50 having an outer diameter of 70 mm is prepared as a material to be polished, and shaping (cutting) and polishing processes are performed thereon. In a step of calculating the aspherical shape of the spectacle lens 5 to be polished before the polishing process, the outward shape of the shaped lens is calculated, setting the thickness t of the outline of an outer circumferential portion of the shaped spectacle lens 5 to 2.0 mm. According to the calculated outward shape, the length from the rotation center O1 of the spectacle lens 5 to the outer circumferential portion thereof is in a range of 14 mm (the minimum value; that is, a shortest diameter f of 28 mm) to 30 mm (the maximum value; that is, an outmost diameter d of 60 mm).

The cutting process (shaping process) is performed on the basis of the surface and outward shapes of the calculated spectacle lens 5. An R chamfering is performed on the circumferential edge of the spectacle lens 5, at the time of the cutting process, to form a chamfered surface r having a curvature radius of 1.0 mm.

An elastic polishing body 3 having an outer diameter D of 40 mm, which is smaller than the outmost diameter d (60 mm) of the spectacle lens 5 and is larger than 32 mm which is obtained by subtracting the shortest diameter f (28 mm) of the spectacle lens 5 from the outer diameter d (60 mm) of the spectacle lens 5, is used as an elastic polishing tool 1.

In addition, the moving distance e of the rotation center O2 of the elastic polishing tool 1 (the elastic polishing body 3), which is moved relative to the spectacle lens 5, from the rotation center O1 of the spectacle lens 5 is set to 14 mm which is the minimum length from the rotation center O1 of the spectacle lens 5 to the outer circumferential portion thereof (that is, the moving range of the rotation center of the elastic polishing tool 1 which is moved relative to the spectacle lens 5 is set to 28 mm). Further, the elastic polishing tool 1 comes into pressure contact with the surface 5*a* to be polished of the spectacle lens 5 with a pressure of 0.1 MPa, and the number of rotations of the elastic polishing tool 1 is set to 1400 rpm. Meanwhile, the spectacle lens 5 is rotated at 500 rpm, and moves on the elastic polishing tool 1 at the rate of one reciprocation every ten seconds. In this way, the polishing process is performed for two minutes.

In the polishing process, since the polishing pad 4 adhered to the elastic polishing body 3 is not peeled off, the spectacle lens 5 has the polished surface 5*a* without polishing chips and scratches. Thus, it is possible to obtain a spectacle lens 5 having a desired quality in appearance.

Twenty-first Comparative Example

Similar to the twenty-first example, a spectacle lens 5, which is a polishing target, having a circumferential portion whose outline (outward shape) has a substantially elliptical shape and a sharp edge is prepared. Then, polishing is performed on the spectacle lens 5 under the same conditions as those in the twenty-first example except that the moving distance e of the elastic polishing tool 1 which is moved relative to the spectacle lens 5 is set to 40 mm which is larger than the minimum length of 25 mm from the rotation center O1 of the spectacle lens 5 to the outer circumferential portion thereof (that is, the moving range of the rotation center of the elastic polishing tool 1 which is moved relative to the spectacle lens 5 is set to 80 mm equal to the outmost diameter d of the spectacle lens 5).

However, in this case, immediately after the polishing starts, the edge of the spectacle lens 5 having a substantially elliptical outward shape and a sharp edge is dug into the polishing pad 4 adhered to the elastic polishing body 3, which causes the spectacle lens 5 and the elastic polishing tool 1 to be damaged, resulting in a poor spectacle lens 5.

Twenty-second Comparative Example

Similar to the twenty-second example, shaping (cutting) and polishing processes are performed by using an elastic polishing body 3 and a circular semifinished lens 50 having an outer diameter of 70 mm.

The shaping and cutting processes are performed on the spectacle lens 5 under the same conditions as those in the twenty-second example except that the moving distance e of the rotation center O1 of the elastic polishing tool 1 which is moved relative to the spectacle lens 5 is set to 30 mm which is larger than the minimum length of 15 mm from the rotation center O1 of the spectacle lens 5 to the outer circumferential portion thereof (that is, the moving range of the rotation center of the elastic polishing tool 1 which is moved relative to the spectacle lens 5 is set to 60 mm equal to the outmost diameter d of the spectacle lens 5).

However, in this case, immediately after the polishing starts, the edge of the spectacle lens 5 having a substantially elliptical outward shape and a sharp edge is dug into the polishing pad 4 adhered to the elastic polishing body 3, which causes the spectacle lens 5 and the elastic polishing tool 1 to be damaged, resulting in a poor spectacle lens 5.

As can be seen from the examples and the comparative examples, when the outer diameter of the elastic polishing tool 1 (the diameter of the elastic polishing body 3) moved relative to the spectacle lens 5 has the value obtained by the following expression: 'the outer diameter of the elastic polishing tool 1≧(the outmost diameter d of the substantially elliptical portion of the spectacle lens 5—the shortest diameter f of the substantially elliptical portion of the spectacle lens 5)', the polishing pad 4 adhered to the elastic polishing body 3 is not peeled off, and thus the spectacle lens 5 has the polished surface 5*a* without polishing chips and scratches. (the twenty-first to twenty-third examples). In addition, in the polishing process, the moving distance e of the rotation center O2 of the elastic polishing body 3 is set within the length from the rotation center O1 of the spectacle lens 5 to a part of the outer circumferential portion (the outline of the outer circumferential portion) closest to the rotation center O1 of the spectacle lens 5 (that is, the moving range of the rotation center of the elastic polishing body is within the shortest diameter f). In this case, the same effects as described above can be obtained (the twenty-first to twenty-third examples).

Meanwhile, when the moving distance e of the rotation center O2 of the elastic polishing tool 1 moved relative to the spectacle lens 5 is set to be larger than the minimum length from the rotation center O1 of the spectacle lens 5 to the outer circumferential portion thereof, even though the same elastic polishing body 3 as those in the twenty-first and twenty-second examples is used, the edge of the spectacle lens 5 having a substantially elliptical outward shape and a sharp edge is dug into the polishing pad 4 adhered to the elastic polishing body 3, which causes the spectacle lens 5 and the elastic polishing tool 1 to be damaged. Thus, a spectacle lens 5 having a desired quality cannot be obtained (the twenty-first and twenty-second comparative examples).

What is claimed is:

1. A lens preparation method comprising:

selecting, among a plurality of polishing tools, a polishing tool having a first curvature radius which is smaller than an average curvature radius of a surface to be polished of a lens, wherein said first curvature radius is closer to the average curvature radius of the surface than any of the curvature radii of the plurality of polishing tools;

bringing the elastic polishing tool having an outer diameter smaller than a length of a major axis of the lens into contact with the surface to be polished of the lens; and rocking the elastic polishing tool and/or the lens while rotating the lens in one direction and rotating the elastic polishing tool in an opposite direction, thereby polishing said surface, wherein an outer circumference of said lens has a non-circular elliptical shape, and wherein a moving range of a rotation center of the elastic polishing tool which moves relative to the lens is within a length of a minor axis of the substantially elliptical shape, and wherein the moving range of the rotation center of the elastic polishing tool while the elastic polishing tool is in contact with the lens, is a circular region having a radius that extends along the minor axis of the lens from a rotation center of the lens to the outer circumference of the lens.

2. The lens preparation method according to claim 1, wherein the outer diameter of the elastic polishing tool has a value obtained by the following expression:

the outer diameter of the elastic polishing tool≧(the length of the major axis of the lens—the length of the minor axis of the lens).

3. The lens preparation method according to claim 1, further comprising:

calculating a surface shape and an outline of the lens;

shaping the surface to be polished by cutting an unfinished lens of which the lens is to be formed, on the basis of the calculated surface shape and outline; and polishing the shaped surface after said shaping.

4. The lens preparation method according to claim 2, wherein the moving range of the rotation center of the elastic polishing tool while the elastic polishing tool is in contact with the lens, is a circular region having a radius that extends along the minor axis of the lens from a rotation center of the lens to the outer circumference of the lens.

5. The lens preparation method according to claim 2, further comprising:

calculating a surface shape and an outline of the lens;

shaping the surface to be polished by cutting an unfinished lens of which the lens is to be formed, on the basis of the calculated surface shape and outline; and polishing the shaped surface after said shaping.

6. The lens preparation method according to claim 1, further comprising:

calculating a surface shape and an outline of the lens;

shaping the surface to be polished by cutting an unfinished lens of which the lens is to be formed, on the basis of the calculated surface shape and outline; and polishing the shaped surface after said shaping.

7. The lens preparation method according to claim 3, wherein a thinnest part of the outer circumference of the lens with respect to a direction perpendicular to the major axis of the lens has a thickness which is larger than zero and is smaller than 2 mm after said shaping.

8. The lens preparation method according to claim 1, wherein the rocking the elastic polishing tool and/or the lens comprises polishing all of the surface of the lens.

* * * * *